US005174850A

United States Patent [19]

Stefan

[11] Patent Number: 5,174,850

[45] Date of Patent: * Dec. 29, 1992

[54] TAPE DISPENSER

[76] Inventor: Alexander Stefan, 216 E. Arby Ave., Las Vegas, Nev. 89119

[ * ] Notice: The portion of the term of this patent subsequent to Feb. 29, 2008 has been disclaimed.

[21] Appl. No.: 329,366

[22] Filed: Mar. 24, 1989

[51] Int. Cl.[5] ..... B32B 31/00

[52] U.S. Cl. ..... 156/324; 225/65; 156/323; 156/527; 156/576; 156/577; 156/579; 156/523

[58] Field of Search ..... 156/270, 527, 574, 579, 156/577, 523, 526, 530, 531, 532, 533, 534; 225/65, 56; 222/533, 534, 535

[56] References Cited

U.S. PATENT DOCUMENTS

| | | | |
|---|---|---|---|
| 3,134,526 | 5/1964 | Schleicher | 225/65 |
| 3,187,968 | 6/1965 | Favre | 225/56 |
| 3,364,096 | 1/1968 | Hetes | 156/579 |
| 3,717,540 | 2/1972 | Henc | 156/577 |
| 3,900,362 | 8/1975 | Schaffer | 156/574 |
| 4,104,110 | 8/1978 | Macosko | 156/577 |

*Primary Examiner*—David Simmons
*Assistant Examiner*—Chester T. Barry
*Attorney, Agent, or Firm*—Charles C. Corbin

[57] ABSTRACT

A tape dispenser, particularly suited for masking tape or like low-tensile strength adhesive tape, and having a frame with a hub portion that provides a cylindrical surface for rotatably mounting a roll of tape and having a central finger-receiving aperture therein. A support wall extends radially from a first side of the hub portion to hold an axially extending flange spaced from a minor segment of the cylindrical surface, whereby the finger-receiving aperture and the flange provide means for grasping the dispenser and not interfering with the rotation of a roll of tape mounted on the dispenser. A swinging arm has one end mounted to the first side of the hub portion, at a location generally radially opposite the flange for rotation about an axis parallel to the axis of the cylindrical surface, and has an application roller mounted at its other end to also rotate about an axis parallel to the axis of the cylindrical surface. There is means for limiting the range of swinging motion of the swinging arm so that it is rotatable in one direction to a first position in which further rotation is prevented and in which the roller is held spaced from the periphery of a mounted roll of tape, and rotatable in the other direction to bring the roller into rollable contact with the roll periphery. This tape dispenser construction allows a form of tape dispensing unto an article surface in which tape passes from the roll around the roller and unto the article surface as the roller is pressed between the periphery of a rotating roll of tape and the article surface.

11 Claims, 3 Drawing Sheets

TAPE DISPENSER

BACKGROUND OF THE INVENTION

1. Field of the Invention

The present invention relates to dispensers for adhesive tape, and particularly to a dispenser that rotatably mounts a roll of tape and uses an application roller that can be moved into engagement with the periphery of the roll of tape as tape is dispensed over the roller and unto a surface.

2. Description of Related Art

Dispensers are known and available for holding a roll of pressure sensitive tape for being applied to a surface. This includes masking tape dispensers for masking a surface in preparation for spray painting and like treatment of adjacent surfaces. Prior dispensing devices, however, stand lacking in several respects and a need remains particularly for an improved dispenser for masking tape.

Devices, such as the tape applicator shown in U.S. Pat. No. 4,238,271, are designed to be pulled along a surface as tape is applied to that surface. If a hand-held dispenser applied tape to a surface at a location forward of the dispenser and ahead of the direction of travel of the dispenser as it is pushed along that surface, the operator would be afforded the ability to visually guide tape application in a manner previously unavailable, with improved accuracy, ease and effectiveness. Such an improved dispenser would be adept at following varying surface contours, and curved lines as well as straight ones. It is also noted that prior tape dispensing designs include relatively complex mechanisms for severing a piece of applied tape.

SUMMARY OF THE INVENTION

In view of the foregoing it is a general object of the present invention to provide a dispenser for masking tape and the like by which tape may be quickly, efficiently and easily applied to a surface.

It is a particular object of the present invention to provide a hand-held dispenser which lends itself to applying tape along curved lines and on non-planar surfaces as well as in straight lines and planar surfaces.

A further object is to provide a masking tape dispenser which may be pushed along a surface during application with the point of tape application lying forward of the dispenser.

A still further object is to provide a tape dispenser having a sample, economical construction.

Another object is to provide a tape dispenser adapted to dispense and sever high tensile strength tape as well as low strength tape such as masking tape.

And still another object is to provide a tape dispenser that can dispense tape in a pulling mode when desired.

These and further objects and advantages are provided by the present invention which contemplates a novel tape dispenser having a frame that includes a hub portion which provides a cylindrical surface for rotatably receiving a roll of tape, the hub also having a central, finger-receiving aperture therein. An axially extending, arcuate flange is supported by a wall extending radially relative to the cylindrical surface from a first side of the hub portion, and lies spaced opposite a minor segment of the cylindrical surface. The flange and the central, finger-receiving aperture combine to provide means for manipulating, and maneuvering the device without interfering with the rotation of a roll of tape mounted thereon. This feature of construction will also, as desired in certain tape dispensing modes, allow the side of a tape roll to be pressed by the thumb or fingers of the hand to generate tension in a strip of tape being applied to the surface of an article. The invented dispenser features a swinging arm that has one end pivotally mounted to the first side of the hub portion at a location that is generally diametrically opposed from the flange and which arm swings about an axis parallel to the axis of the cylindrical surface. The other end of the arm mounts an application roller which also rotates about an axis parallel to that of the cylindrical surface. The arm is rotatable in a first direction to a position in which the roller is spaced from the cylindrical surface and the periphery of a roll of tape carried thereon, and there is means preventing further rotation of the arm in this first direction. The arm is swingable in the opposite direction to bring the roller into rollable engagement with the periphery of the mounted roll of tape. This dispenser construction allows tape to be applied to a surface in a dispenser pushing mode, quite advantageous for masking tape application, with tape passing from the roll around the roller and onto an article surface and with the roller pushing the tape into adhesive contact with the article surface as the roller simultaneously engages the periphery of the rotating roll of tape. The invented dispenser is also adapted to dispense tape, when desired, in a pulling mode, with tape passing from the roll of tape and around the roller which is held in position spaced from the tape periphery. One variant of the invented dispenser has means affixed to a forward edge of the flange, for severing reinforced tape.

DETAILED DESCRIPTION OF PREFERRED EMBODIMENT

Figure 1:
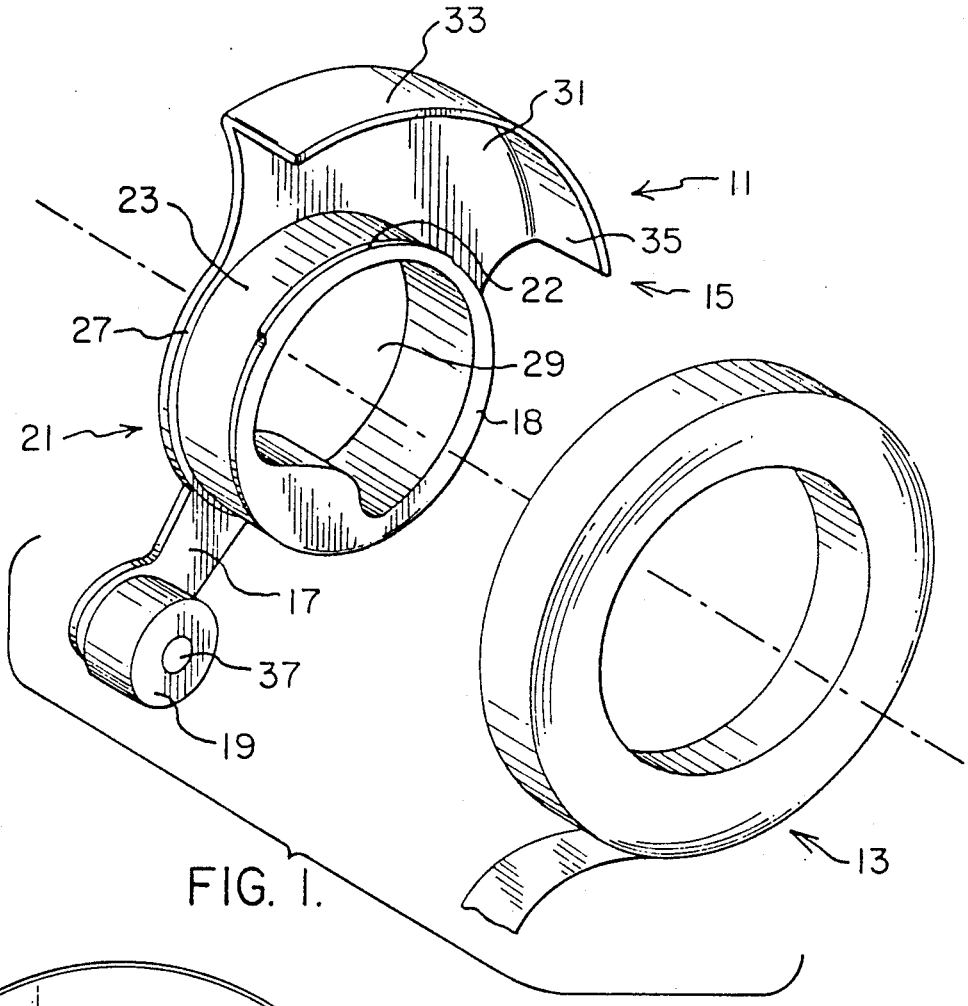
FIG. 1 is a perspective view showing a preferred embodiment of the tape dispenser of the present invention, and a roll of masking tape for which that dispenser is designed to mount.

Referring now to the drawings, FIG. 1 shows a preferred embodiment according to the invention in the form of a tape dispenser 11 which is particularly suited for holding and dispensing a roll 13 of masking tape. The main components of dispenser 11 comprise a support frame 15, a pivoting arm 17 and an application roller 19. Frame 15 is preferably molded of a suitable polymeric material, however it may also be constructed of a light weight metal, such as aluminum. Frame 15 features a hub portion 21 characterized by a cylindrical surface 23, over which the tape roll 13 may be rotatably received. The forward end 18 of the hub portion 21 is slightly smaller in diameter than the core of the tape roll 13 and is provided with a lip portion 22 that extends partially along the periphery of the hub forward end 18.

Figure 3:
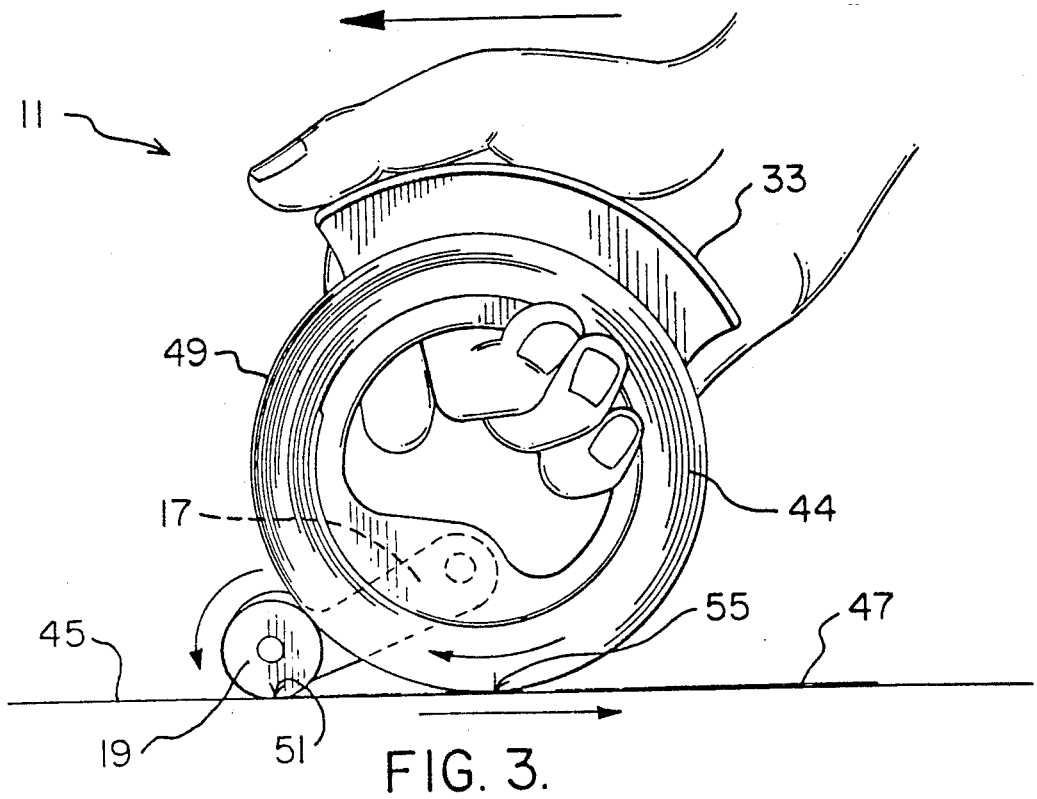
FIG. 3 is a side elevational view showing the embodiment of FIG. 1 used in a pushing mode to apply masking tape to a surface.

Roll 13 may be placed over the end 18, and lip 22, and thereby mounted on cylindrical surface 23 with the lip portion 22 helping to retain the mounted roll in place. FIG. 3 illustrates such a roll 13 mounted on dispenser 11. A web 31 which will be further described hereinafter and a partially circumferential ledge 27 will help maintain roll 13 aligned upon surface 23, for rotation thereon in a manner to be described.

Hub portion 21 has a central aperture 29 therein which is adapted for admitting a person's fingers.

Figure 4:
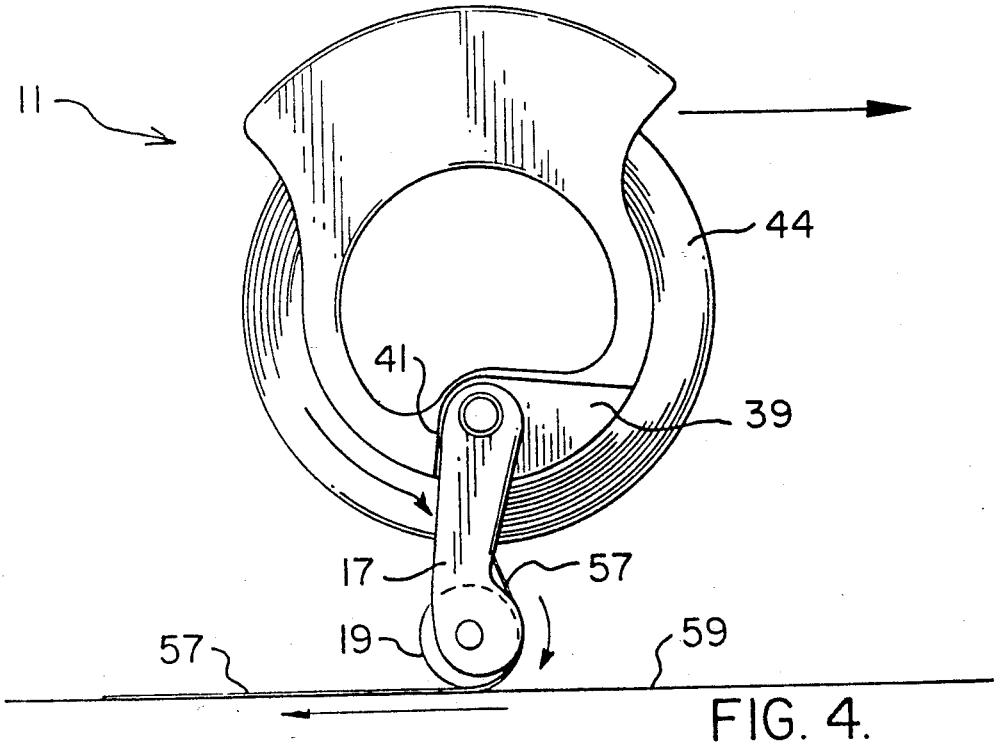
FIG. 4 is a side elevational view showing the tape dispenser of FIG. 3 used in a pulling mode to apply tape to a surface.

Support web 31 extends from the rear side of hub portion 21 and supports an arcuate flange 33 with its inner surface 35 spaced from a minor segment of the cylindrical surface 23. The flange surface 35 is wider than a tape roll 13 and the spacing of flange 33 from the finger-admitting aperture 29 is designed to allow dispenser 11 to be grasped firmly and comfortably in a manner that will not interfere with rotation of a mounted roll 13. It is noted that the aforedescribed structure is designed to leave exposed and uncovered a major part of the peripheral and side surfaces of a mounted roll of tape, as illustrated in FIGS. 3 and 4. This feature lends to the simplicity and economy of the dispenser 11. In addition, this will prove advantageous when a dispenser according to the invention is used for dispensing reinforced tape, as will be described by reference to FIG. 5 since the thumb of the hand may be pressed against a mounted roll to control the tension in the tape as it is applied to an article in a wrapping mode.

Figure 2:
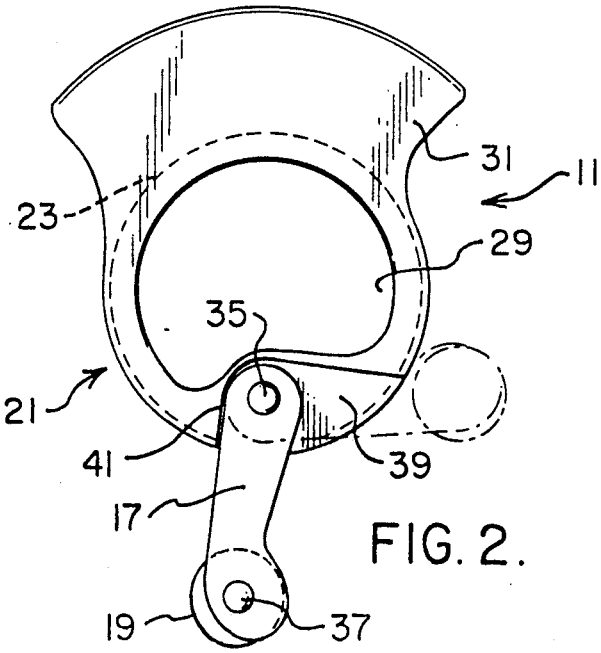
FIG. 2 is a rear elevational view of the dispenser of FIG. 1.

FIGS. 1 and 2 which best illustrate the pivoting arm 17 and application roller 19, show one end of arm 17 pivotally connected by pin 35 at a location on the rear side of hub portion 21 that is generally diametrically opposed, (with reference to cylindrical surface 23), to the flange 33. Arm 17 will thus pivot about an axis parallel to that of the cylindrical surface 23. The application roller 19 rotates freely about pin 37, which is parallel to pin 35. Thus mounted, the roller 19 is spaced in alignment from the cylindrical surface 23. Note that the upper part of arm 17 lies in a recessed shelf 39 featuring an edge 41 which arm 17 will abut to hold it against further clockwise rotation beyond the position shown in FIG. 2. Here the arm 19 extends generally radially with respect to cylindrical surface 23 so as to hold roller 19 spaced at or near a maximum distance from cylindrical surface 23. FIG. 2 also illustrates that arm 17 may be rotated from its radially extended position towards a second position, here shown in phantom lines, in which roller 19 is adjacent the cylindrical surface 23. With arm 19 in its extended position a roll of tape may be loaded upon the cylindrical surface 23 and the aforedescribed mechanism will then allow roller 19 to be moved into contact with the periphery of that roll of tape, and away therefrom as desired. In the preferred embodiment pins 35 and 37 are of steel and arm 17 is formed of a suitably strong polymeric material. Roller 19 is preferably made of a polymeric material with sufficient resilient qualities to make it useful for pressing tape unto non-planer surfaces as well as flat surfaces in a manner to be described.

FIG. 3 illustrates a unique and advantageous pushing mode of applying masking tape to a surface that is permitted by the novel construction of a dispenser according to the present invention. Here is shown a length of tape 47 being applied to a surface 45. Also note that arm 17 has swung to bring roller 19 into contact with the periphery 49 of the roll 44 of masking tape. The tape follows a path around roller 19 and to surface 45. As dispenser 11 is urged to the left as viewed in FIG. 3, with downward and forward force, the tape periphery 49 presses against roller 19, which in turn presses tape 47 into adhesive engagement with surface 45. Also note that during this dispensing operation the roller 19 is caused to rotate, as indicated, by virtue of the tangential pull of dispensing tape along its periphery, and the roller 19 in turn helps to cause rotation of tape roll 44 on its mounting in the direction indicated by arrow. It is also to be noted that the pivoting action of arm 17 will allow the roller 19 to be maintained in contact with roll periphery 49 as the diameter of roll 44 decreases with use, from full roll to its empty condition. It is further noteworthy that the point of tape application, indicated by reference numeral 51, lies forward of dispenser 11 which is visually advantageous and allows the user to apply masking tape with a high degree of precision. The novel construction of dispenser 11 may allow additional pressure to be exerted on an applied strip of tape, as desired, when the periphery 49 of the tape roll 44 is urged into sliding contact with applied strip 47 at pressure region 55.

It will be appreciated that dispenser 11 will permit an easy, and quick way of severing the end of an applied strip of masking tape. This is accomplished by pressing stationary roller 19 downward upon the tape as the dispenser is manipulated to twist roller 19 about a vertical axis therethrough.

The versatility of the invented dispenser is illustrated in FIG. 4 wherein dispenser 11 is used to dispense tape in a pulling mode rather than the aforedescribed pushing mode. Here, as dispenser 11 is pulled to right, the arm 17 is urged to the left and restrained by edge 41 in its extended position. Tape strip 57 leaves roll 44, passes around roller 19 which presses it into adhesion with surface 59.

Figure 5:
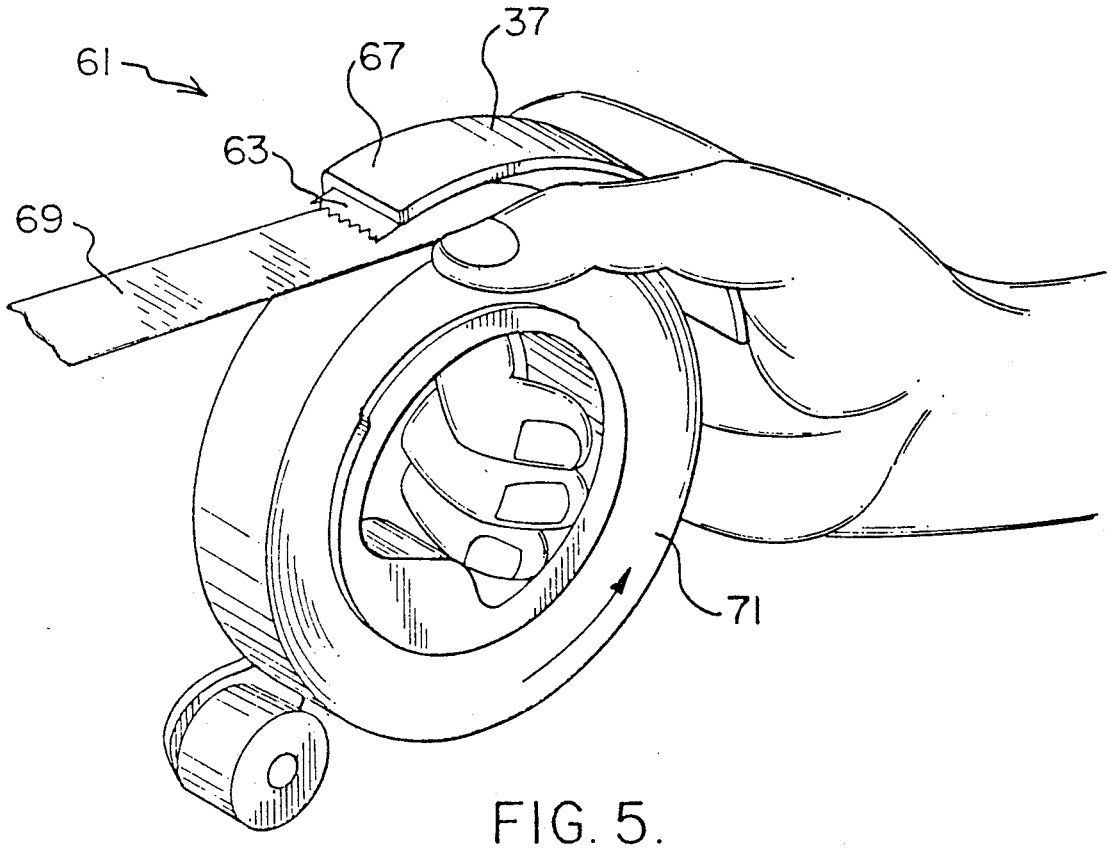
FIG. 5 is a view in perspective of a variant of the tape dispenser of the invention, for dispensing high tensile strength tape.

FIG. 5 shows a variant 61 of a dispenser according to the invention which is particularly adapted for dispensing high strength, reinforced tape, such as tape used in packaging. Variant 61 features a serrated cutting edge 63 that extends as shown from the leading portion 67 of flange 33. As a length 69 of tape is unrolled from roll 71, for example during wrapping of an article, it is desirable to tension tape 69. This is simply accomplished by bringing the thumb against roll 71 to slidingly hold it against rotation. Tape 69 may be cut by manipulating the dispenser 61 to bring the cutting edge 63 to bear upon tape 69.

While a particular embodiment of the invention has been described herein, it is not intended that the invention be limited thereto, since various modifications and changes may readily occur to those skilled in the art without departing from the invention. Therefore it is aimed to cover all such changes and modifications as fall within the true spirit and scope of the invention as described in the claims which follow.

What is claimed is:

1. Adhesive tape dispenser comprising:

a) frame, adapted for holding a roll of tape and for being grasped by hand, and having a hub portion with a cylindrical surface for receiving the circular core of said roll of tape for rotation thereon, and said hub portion having a central finger-receiving aperture therein;

b) support wall extending radially, relative to said cylindrical surface, from a first side of said hub portion;

c) arcuate flange extending axially from the outer periphery of said support wall and lying spaced from a minor segment of said cylindrical surface, and cooperating with said central aperture to provide means to grasp said frame without grasping said roll of tape mounted on said cylindrical surface;

d) swinging arm, having a first end that is pivotally mounted to the first side of said hub at a location generally radially opposite said flange, with respect to said cylindrical surface and said arm being pivotable about an axis parallel to the axis of said cylindrical surface;

e) applicator roller, mounted at the other end of said swinging arm, for rotation about an axis parallel to the axis of said cylindrical surface, and said roller held in alignment with, and opposed from, said cylindrical surface; and f) means for limiting the pivoting of said swinging arm, so that it is rotatable in one direction to a first position in which further rotation is prevented and being rotatable in the other direction so as to bring said roller towards a position adjacent said cylindrical surface, whereby said roller may be brought into rolling contact with the outer surface of said roll of tape mounted on said cylindrical surface.

2. Tape dispenser as defined in claim 1 herein said means for limiting the pivoting of said arm includes an axially projecting surface on the first side of said hub.

3. Tape dispenser as defined in claim 2 wherein said axially projecting surface lies on a generally radially extending wall.

4. Tape dispenser having a construction as defined in claim 1 whereby a major part of the surface of a roll of tape held thereon is uncovered.

5. Tape dispenser as defined in claim 1 wherein said frame, support wall and flange cover a minor part of the surface of a roll of tape held on said frame.

6. Tape dispenser as defined in claim 1 wherein said arm lies, in its first position, in a direction generally perpendicular to said cylindrical surface.

7. Tape dispenser as defined in claim 1 wherein the inner surface of said flange is at least as wide as said cylindrical surface.

8. Tape dispenser as defined in claim 1 including means for severing tape affixed to a forward end of said flange.

9. Dispenser as defined in claim 1 including means for severing tape wherein said means is attached to the end of said flange and said means is closer to said roller when said roller is brought adjacent said cylindrical surface.

10. Method for applying tape to an article surface employing a tape dispenser having a frame with a hub portion that provides a cylindrical surface for rotatably holding a roll of said type and a finger-receiving central opening in said hub portion; a flange supported and spaced from a minor segment of said cylindrical surface so that said frame may be grasped by hand without interfering with rotation of said roll; and a pivoting arm having one end mounted to said hub portion at a location generally radially opposite flange to swing about an axis parallel to the axis of said cylindrical surface, and having a roller mounted to the other end of said arm for rotation about an axis parallel to the axis of said cylindrical surface and wherein said arm is swingable from a position in which said roll is spaced a first distance from said cylindrical surface to a position in which said roller is brought into rollable engagement with the outer surface of said roll of tape; said method comprising the steps of:

a) placing said roller into contact with said roll outer surface;

b) extending a lead portion of said tape from said roll and around said roller with the non-adhesive side of tape engaging said roller;

c) pressing, with said roller, said lead of tape into adhesive engagement with said article surface as said outer surface of said roll is urged into engagement with said roller; and d) moving said dispenser in a direction parallel to said article surface to cause said roll to rotate as tape is applied to said article surface as said roller is simultaneously and continuously contacting both said article surface and the outer surface of said roll of tape as the diameter of said roll decreases.

11. Method as defined in claim 10 including pressing said outer surface of said roll of tape into sliding engagement with tape applied to said article surface.

* * * * *